United States Patent [19]

Hall

[11] 4,114,551

[45] Sep. 19, 1978

[54] GOOSE-NECK FITTING

[75] Inventor: Eric R. D. Hall, Marion, Mass.

[73] Assignee: Schaefer Marine Products, New Bedford, Mass.

[21] Appl. No.: 867,384

[22] Filed: Jan. 6, 1978

[51] Int. Cl.[2] ..... B63H 9/04

[52] U.S. Cl. ..... 114/98; 403/24; 403/287

[58] Field of Search ..... 114/97, 98, 106, 102, 114/95, 90; 52/731; 403/377, 192, 74, 24, 25, 287

[56] References Cited

U.S. PATENT DOCUMENTS

| | | | |
|---|---|---|---|
| 361,049 | 4/1887 | Campbell | 114/95 |
| 3,063,523 | 11/1962 | Triplett | 52/731 |
| 3,522,786 | 8/1970 | Randell-Clark | 114/106 |

FOREIGN PATENT DOCUMENTS

| | | | |
|---|---|---|---|
| 557,517 | 5/1958 | Canada | 52/731 |

*Primary Examiner*—Andrew V. Kundrat
*Attorney, Agent, or Firm*—Cesari and McKenna

[57] ABSTRACT

A goose-neck fitting used to form a universal joint between a boat mast and a hollow thin-walled boom or spinnaker pole comprises a tubular socket received into the end of the pole adjacent the mast. The sleeve is suspended in the pole parallel to the pole axis by footings which, with the sleeve, form an H-like truss that extends between the opposite walls of the pole for an appreciable distance inward from the pole end. When in use the sleeve receives a male connector member swivelly mounted on the mast, the goose-neck connection opposes shear forces acting on the pole so as to maintain the pole in the proper orientation with respect to the mast and enable the pole end to withstand the substantial shear forces acting upon it at the point of its connection to the mast.

5 Claims, 3 Drawing Figures

GOOSE-NECK FITTING

BACKGROUND OF THE INVENTION

This invention relates to a goose-neck connection for use on a sailboat to connect a boom or spinnaker pole to the boat mast. It relates more particularly to the portion of such a connector that is located in the end of the pole or boom.

A goose-neck is a two-axis pivot joint or a universal joint that permits the pole or boom to be swung in vertical and horizontal planes relative to the mast. Typically, the goose-neck includes a male connector member that is swivelly mounted to the mast and a female connector member that is anchored in the end of the pole adjacent to the mast. The connector members can be removably joined together to secure the end of the pole to the mast while permitting its aforesaid swinging movements relative thereto.

In recent years, the poles and booms used on many sailboats have comprised thin-walled, extruded aluminum tubes. The goose-neck connector element in the pole is usually in the form of a rigid cylindrical socket on the order of two inches long made of a strong material such as steel. The socket is welded to one side of a rigid metal plate and this plate is riveted or screwed to a wall of the pole with the socket being located adjacent the end of the pole and extending parallel to the pole axis.

The pole is connected to the mast by plugging the male connector member into the socket, there usually being some kind of detent present on the connector members to removably lock them together.

During normal use, the goose-neck connection between the pole and mast is subjected to very large shear forces. As a result, the thin, relatively soft aluminum wall to which the sleeve and its plate are connected deforms and even tears in the region near the sleeve. This wall deformation cocks the sleeve and upsets the proper orientation of the goose-neck relative to the mast thereby degrading the sailing characteristics of the boat. Further, in extreme cases the sleeve can actually tear completely out of the pole thereby freeing the pole from the mast and presenting a clear danger to the occupants of the boat.

SUMMARY OF THE INVENTION

Accordingly, the present invention aims to provide an improved goose-neck connection for a sailboat.

Another object of the invention is to provide a goose-neck which is designed particularly for use in connection with thin-walled, tubular, aluminum spinnaker poles and booms.

A further object of the invention is to provide a goose-neck connection for installation in a spinnaker pole or boom which is able to withstand relatively large shear forces acting upon the pole or boom.

Still another object of the invention is to provide a goose-neck which is relatively easy and inexpensive to make and install in a boat pole or boom.

Further objects will in part be obvious and will, in part, appear hereinafter.

The invention accordingly comprises the features of construction, combination of elements and arrangement of parts which will be exemplified in the following detailed description, and the scope of the invention will be indicated in the claims.

Briefly, the goose-neck connection disclosed herein comprises a connector member in the form of a rigid steel socket on the order of two inches long. Welded to the opposite sides of the socket are a pair of plates co-extensive with the socket and that extend appreciably above and below the socket so that in cross-section, the connector has the general appearance of the letter H, with the plates constituting the vertical legs of the H and the sleeve forming the horizontal arm thereof. The connector is inserted into the end of the hollow aluminum pole or boom. The ends of the plates engaging the opposite walls of the boom are shaped to conform thereto so that they can be secured permanently to the walls by rivets, screws or the like. The plates thus form footings or struts that support the socket at the end of the pole so that it extends parallel to the axis of the pole intermediate its walls.

The socket is arranged to receive a mating male connector member that is swivelly mounted on the boat mast. When the boat is in use, forces acting on the goose-neck tend to cock the goose-neck socket and its footings, which motion is resisted by the rivet or screw connections between the footings and the pole walls. Thus, rather than these forces being concentrated as shear and bending forces on a single wall of the pole, they are distributed over opposite pole walls a substantial distance along the length of the pole. Further, large components of those forces are redirected by the screws or rivets along the pole walls. Resultantly, spinnaker poles and booms incorporating this goose-neck connection are much less prone to metal fatigue, distortion and misalignment than those employing prior comparable connections. Consequently, they tend to have a long useful life and require relatively little repair and maintenance. Yet with all of these advantages, the present connection is not appreciably more expensive to make and install than prior connectors of this general type that do not have these advantages.

BRIEF DESCRIPTION OF THE DRAWING

For a fuller understanding of the nature and objects of the invention, reference should be had to the following detailed description, taken in connection with the accompanying drawing, in which.

DESCRIPTION OF PREFERRED EMBODIMENT

Figure 1:
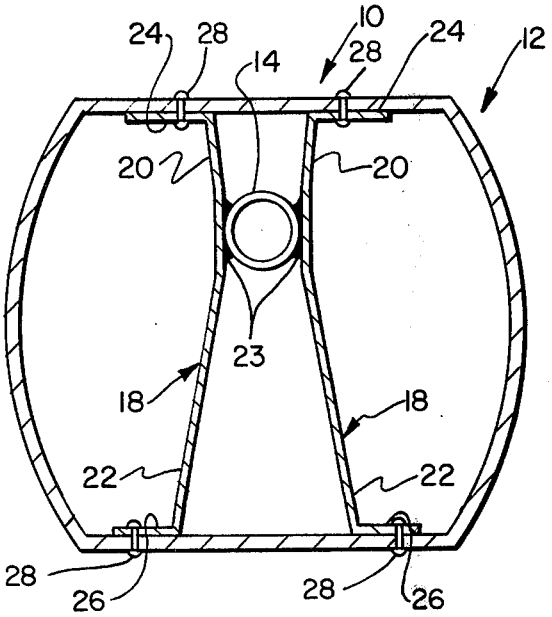
FIG. 1 is a transverse section of a spinnaker pole incorporating my goose-neck connector.
Figure 2:
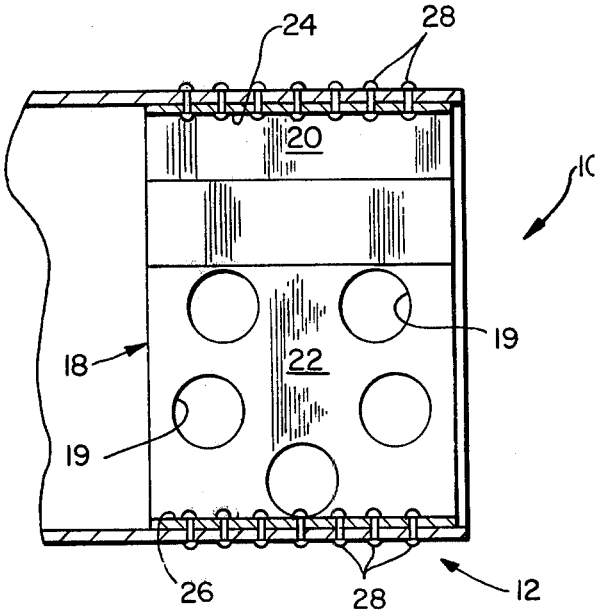
FIG. 2 is a longitudinal section with parts in elevation thereof.
Figure 3:
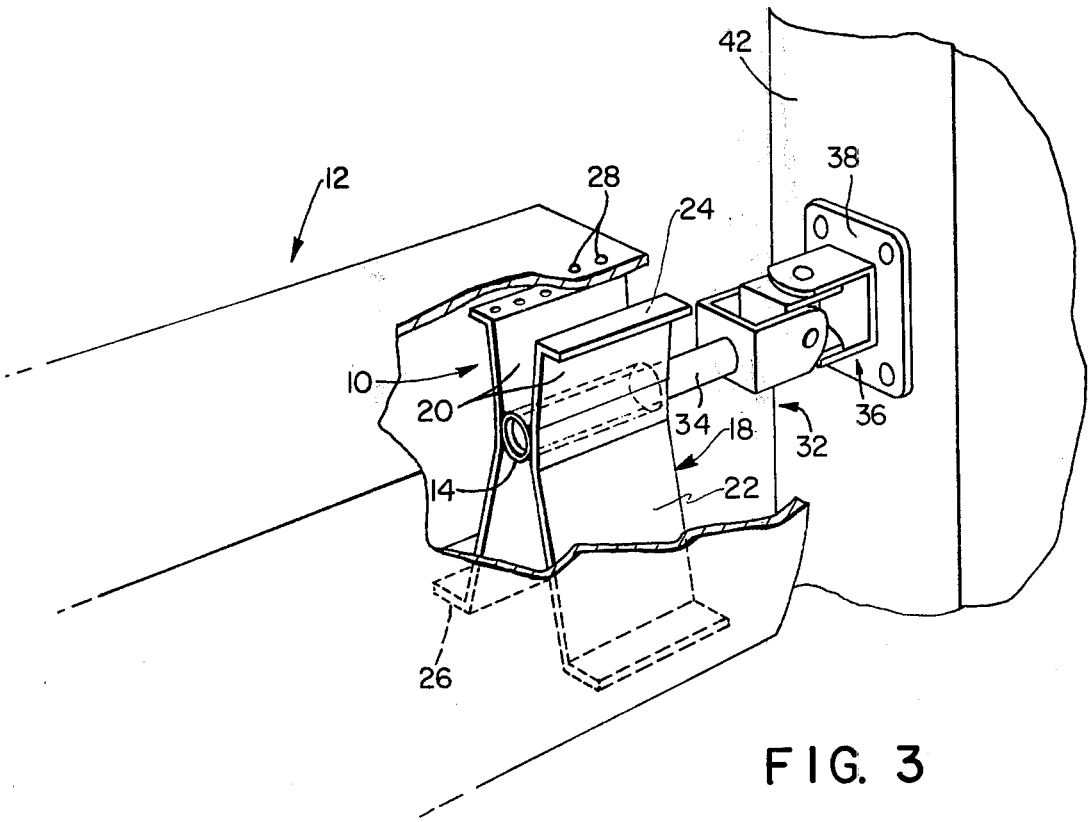
FIG. 3 is a perspective view with parts broken away showing the FIG. 1 pole partially connected to a boat mast.

Referring to FIGS. 1 to 3 of the drawing, a goose-neck connector assembly indicated generally at 10 is mounted inside the end of a tubular thin-walled aluminum spinnaker pole or boom indicated generally at 12. Assembly 10 comprises a tubular sleeve or socket 14. This socket is made of a suitably strong rigid material such as steel or stainless steel and is typically on the order of two inches long. Assembly 10 also includes a pair of mirror image footings shown generally at 18 disposed at opposite sides of socket 14. These footings are in the form of strong rigid steel plates. As seen in FIG. 2, the plates may have material removed as at 19 to reduce their weight without appreciably weakening them. Each footing 18 is permanently secured to socket 14 by welds 23 (FIG. 1) that extend between the footings and the socket along their entire lengths.

As best seen in FIG. 1, the footings 18 have arms 20 that extend up to the upper wall of pole 12, being turned out at that point to form flanges or hands 24 that lie flush against the pole wall. The footings also have relatively long legs 22 that extend down to the bottom wall of pole 12, being turned outward at that point to form flanges or feet 26 that lie flush against the bottom wall of the pole. The arms 20 and legs 22 are splayed to some extent. However, the assembly 10 as viewed in FIG. 1 has the general appearance of an H-shaped truss with the footings 18 forming the vertical components thereof and the socket 14 making up the horizontal element thereof. The flanges 24 and 26 are permanently secured to their adjacent walls by suitable rivets or screws 28.

Referring now to FIG. 3, assembly 10 is designed to cooperate with a male goose-neck connector assembly shown generally at 32. Assembly 32 includes a male plug 34 that is arranged and adapted to be received in socket 14 as indicated in that figure. The plug 34 is connected by way of a two-axis pivot joint shown generally at 36 to a plate 38 anchored to a boat mast 42. In FIG. 3, the connection between the goose-neck assemblies 10 and 32 is only partially made. In use, the plug 34 would extend entirely into socket 14 and normally a standard detent arrangement would be provided to removably lock those two connector members together.

It will be apparent from FIG. 3 that downward or lateral forces acting on the pole end adjacent the goose-neck would tend to cock the socket 14 and footings 18. However, such movement is resisted and prevented because of the securements of the footings over relatively large surfaces at the opposite walls of the pole. The goose-neck assembly 10, being a truss, actually rigidifies the entire end of the pole and assures that forces acting on the relatively soft, thin wall of the pole are bending forces and forces exerted along the lengths of those walls rather than shear forces as occurs in poles and booms equipped with prior conventional goose-neck connectors. In actuality, tests have been conducted which indicate that the present goose-neck construction is on the order of twice as strong as those used on prior spinnaker poles and booms of this general type. Still, however, the present arrangement is not appreciably more expensive than prior ones so that it should find wide acceptance in marine and sailboat circles.

It will thus be seen that the objects set forth above, among those made apparent from the preceding description, are efficiently attained. It should also be understood that certain changes may be made in the above construction without departing from the scope of the invention. For example, the two assemblies forming the goose-neck connection of the present invention can be reversed so that the male connector member 34 is supported in the hollow pole by footings 18 and the socket element 14 is secured to the two axis pivot joint 36. Accordingly, it is intended that all matter contained in the above description or shown in the accompanying drawing shall be interpreted as illustrative and not in a limiting sense.

It should also be understtood that the following claims are intended to cover all of the features of the invention herein described.

I claim:

1. A goose-neck connector assembly for removably connecting the end of an elongated member to a boat mast comprising A. an elongated connector member positioned inside the hollow end of the elongated member with its axis parallel to that of the elongated member;

B. a pair of struts positioned in the elongated member on opposite sides of the connector member and extending between opposite walls of the elongated member said connector member and struts in section having the general shape of the letter H;

C. means for securing said struts to said connector member; and

D. means for securing the ends of said struts adjacent said walls to said walls so that the connector member and struts form a stiffening truss at the end of the elongated member.

2. In a tubular thin-walled sail support, a goose-neck connector assembly comprising A. a pair of rigid plates positioned at the end of the sail support and extending an appreciable distance inward from said end, said plates being spaced apart and extending between opposite walls of said tubular sail support;

B. means for permanently securing the ends of said plates adjacent said walls to said walls;

C. an elongated connector member positioned between said plates and extending parallel to the axis of said sail support;

D. means for permanently securing said plates to the opposite sides of said connector member so that said plates and connector member together form a truss that rigidifies said end of said sail support, and E. a cooperating connector member arranged to mate with said first mentioned connector member so as to connect said sail support to a boat mast.

3. The assembly defined in claim 2 wherein the connector member comprises a tubular socket.

4. The assembly defined in claim 2 wherein

A. the pole is in the form of a thin-walled aluminum tube; and

B. the connector member and struts are made of steel.

5. A goose-neck connector assembly for removably connecting the end of an elongated tubular sail supporting pole to a boat mast comprising A. an elongated connector member positioned inside said pole end with its axis parallel to that of the pole;

B. a pair of struts positioned in the pole on opposite sides of the connector member and extending between opposite walls of the pole;

C. means for securing said struts to said connector member;

D. means for securing the ends of said struts adjacent said pole walls to said walls so that the connector member and struts form a stiffening truss at the end of the pole;

E. a cooperating connector member arranged to removably connect to the first mentioned connector member, and F. means for pivotally connecting the cooperating connector member to a boat mast so that the cooperating connector member and the pole removably connected thereto can swing relative to the mast.

* * * * *